US005774041A

United States Patent [19]

Xydis et al.

[11] Patent Number: 5,774,041

[45] Date of Patent: Jun. 30, 1998

[54] DESIGNER CHIME COVER

[75] Inventors: Thomas Xydis, Ann Arbor; Bob Demick, Eastpoint; Robert Clarke, Madison Heights; Paul Angott, Bloomfield Hills, all of Mich.

[73] Assignee: Dimango Products Corporation, Brighton, Mich.

[21] Appl. No.: 684,291

[22] Filed: Jul. 18, 1996

[51] Int. Cl.[6] ..... G08B 3/00

[52] U.S. Cl. ..... 340/396.1; 40/797; 40/798; 340/330

[58] Field of Search ..... 340/396.1, 326, 340/327, 328, 330, 815.49, 815.73; 40/455, 797, 798, 799; 116/141; D20/12; D10/118; 361/730

[56] References Cited

U.S. PATENT DOCUMENTS

| | | | |
|---|---|---|---|
| D. 133,228 | 7/1942 | Dourson | D10/118 |
| D. 264,320 | 5/1982 | Doggart | D10/118 |
| D. 306,565 | 3/1990 | Pawlik et al. | D10/118 |
| D. 313,570 | 1/1991 | Lomas | D10/118 |
| D. 355,143 | 2/1995 | Lee et al. | D10/110 |
| 1,305,121 | 5/1919 | Klimowicz | 40/798 |
| 2,386,738 | 10/1945 | Corbett | 340/396.1 |
| 2,770,690 | 11/1956 | Sanders | 340/396.1 |
| 2,841,903 | 7/1958 | Christensen | 40/797 |
| 3,246,321 | 4/1966 | Doggart | 340/396.1 |
| 4,129,857 | 12/1978 | Espinosa | 340/330 |

*Primary Examiner*—Jeffery A. Hofsass
*Assistant Examiner*—John Tweel, Jr.
*Attorney, Agent, or Firm*—Howard & Howard

[57] ABSTRACT

A chime cover assembly (10) comprising a box-like housing for supporting the electrical components of a door chime and including a cover (12) presenting a front wall (18) and a base (14) for mounting to a wall (16). The assembly characterized by a decorative plate (30) for being covered with wallpaper (32), or the like, and secured to the front wall (18) of the cover (12). The front wall (18) has holes (34) therein and the plate (30) includes integral projections (36) extending therefrom for insertion into the holes (34) for securing the plate (30) to the front wall (18). The cover (12) presents slanted trim areas (44) at the top and bottom of the front wall (18) and trim strips (46, 48) attach to the housing in the trim areas (44).

33 Claims, 2 Drawing Sheets

FIG-1
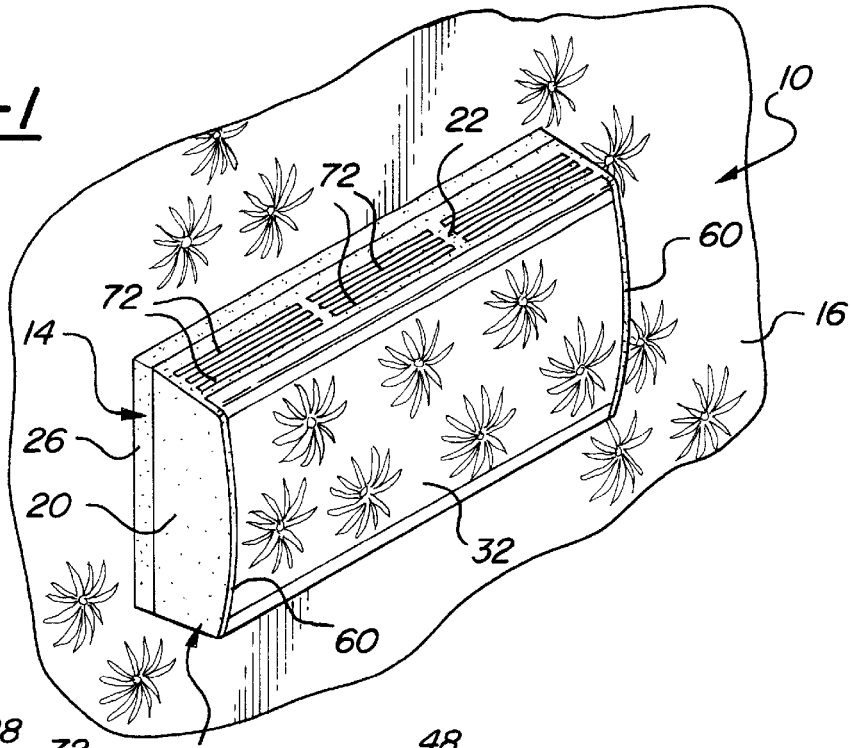
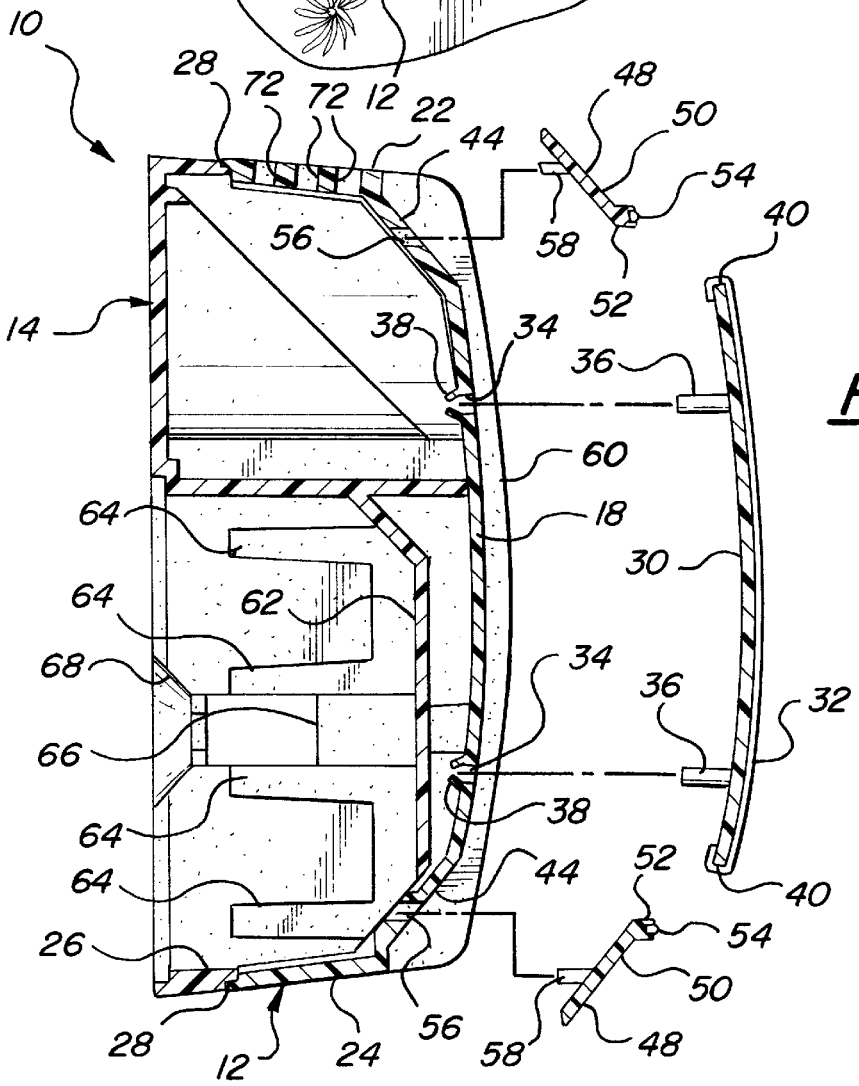
FIG-3

36
30
36
32
42
40
42
60
80
34
12
56
34
44
80
46
10
56
44
80
34
56
60
18
20
46
72
22
14
76
84
74
84
70
62
3
82
76
74
78
3
76
84
28
26

DESIGNER CHIME COVER

TECHNICAL FIELD

The subject invention relates to a door chime housing of the type mounted on a wall in a residence for providing an audible sound in response to activation of a doorbell next to a door on the exterior of the residence.

BACKGROUND OF THE INVENTION

Numerous door chime housings are known in the prior art with various different designs. However, these prior art assemblies each provide a fixed decor to the purchaser. Examples of such assemblies are shown in U.S. Pat. Nos. Des. 133,228 to Dourson, Des. 264,320 to Doggart, Des. 306,565, to Pawlik et al, Des. 312,570 to Lomas and Des. 355,143 to Lee et al.

SUMMARY OF THE INVENTION AND ADVANTAGES

A chime cover assembly comprising a box-like housing for supporting the electrical components of a door chime and including a cover presenting a front wall and a base for mounting to a wall. The assembly is characterized by a decorative plate for being covered with wallpaper, or the like, and thereafter secured to the cover.

Therefore, in accordance with the subject invention the purchaser of the door chime housing may decorate the housing with wallpaper, fabric, or the like, which matches the decor of the residence.

BRIEF DESCRIPTION OF THE DRAWINGS

Other advantages of the present invention will be readily appreciated as the same becomes better understood by reference to the following detailed description when considered in connection with the accompanying drawings wherein:

FIG. 1 is a perspective view of the subject invention mounted on a wall;

FIG. 3 is an exploded cross-sectional view taken substantially along line 3—3 of FIG. 2 but showing an alternative trim strip.

DETAILED DESCRIPTION OF THE PREFERRED EMBODIMENT

Figure 2:
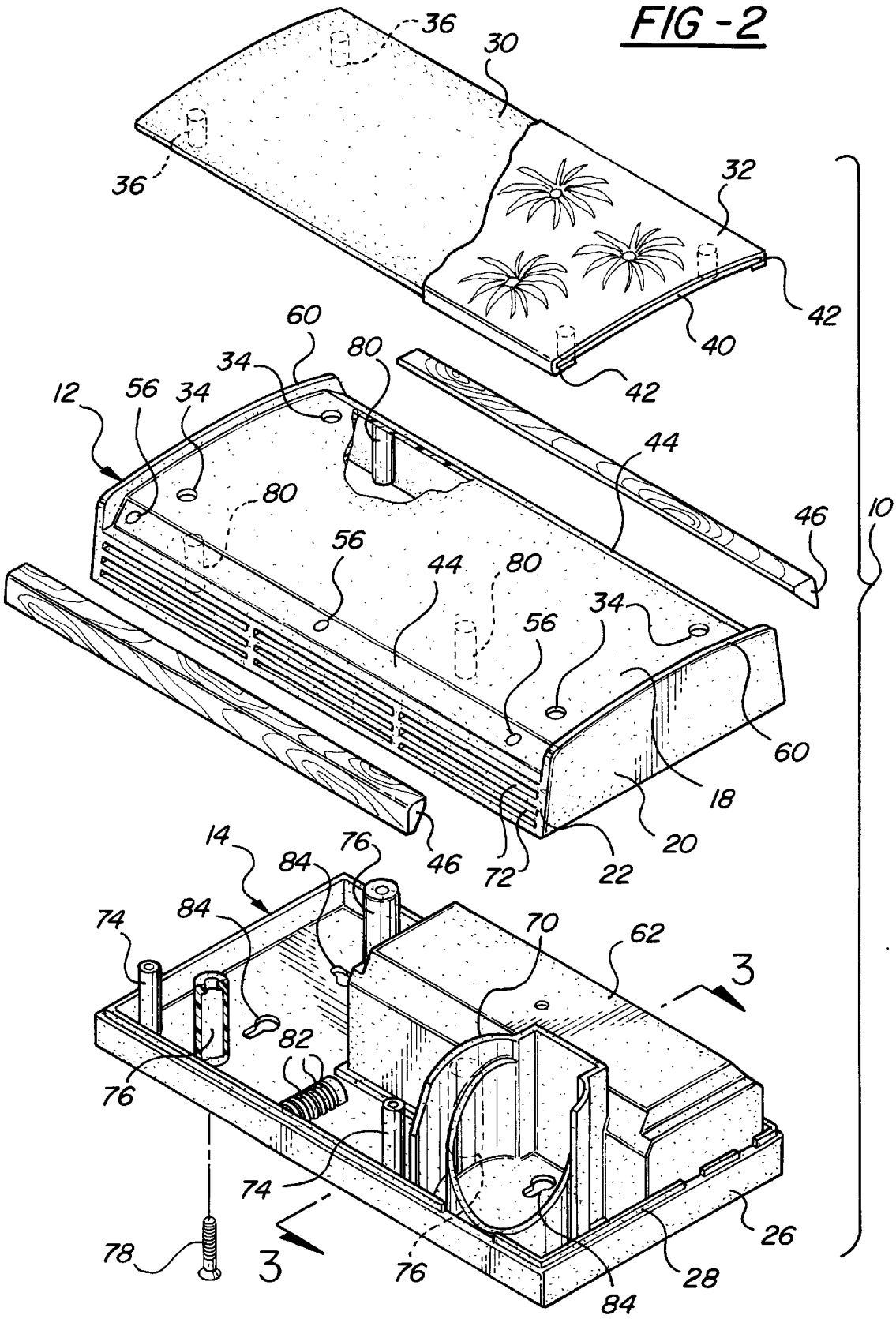
FIG. 2 is an exploded perspective view of the subject invention.

Referring to the Figures, wherein like numerals reference like or corresponding parts throughout the several views, a chime cover assembly constructed in accordance with the subject invention is generally shown at 10. The chime cover assembly 10 comprises a box-like housing for supporting the electrical components (not shown) of a door chime. The housing includes a cover, generally indicated at 12, and a base, generally indicated at 14, for mounting to a wall 16. The cover 12 comprises an integral plastic member and the base 14 comprises an integral plastic member. The cover 12 presents a front wall 18, end walls 20 a top wall 22 and a bottom wall 24. The base 14 includes a peripheral wall 26 to engage and support the walls 20, 22 and 24 of the cover 12 so that the base 14 and the front wall 18 are interconnected by the end walls 20 and top 22 and bottom 24 walls. The peripheral wall 26 of the base 14 and the walls 20, 22 and 24 of the cover 12 present offset and overlapping flanges 28 for mating engagement of the cover 12 on the base 14.

The assembly 10 is characterized by a decorative plate 30 for being covered with wallpaper, fabric, and the like, 32 and is secured to the front wall 18 of the cover 12. The front wall 18 has holes 34 therein and the plate 30 includes integral projections 36 extending therefrom for insertion into the holes 34 for securing the plate 30 to the front wall 18. More specifically, clamping claws 38 are disposed on the interior of the front wall 18 and surrounding the holes 34 for gripping the projections 36 at various degrees of insertion thereinto to accommodate various different thicknesses of the decorative wallpaper or fabric 32 in other words, the clamping claws 38 allow an adjustment of the distance the plate 30 is positioned from the front wall 18.

The plate has top and bottom edges 40 and end edges 42 and the top and bottom edges 40 of the plate 30 are spaced inwardly from the top 22 and bottom 24 walls respectively of the cover 12 to define trim areas 44 between the top edge 40 of the plate 18 and the top wall 22 of the cover 12 and between the bottom edge 40 of the plate 30 and the bottom wall 24 of the cover 12. The wallpaper or fabric 32 is wrapped around the top and bottom edges 40 of plate 30 and may be clamped to the front wall 18 and/or may be adhesively secured to the plate 30.

A variety of trim strips are included for attachment to the housing in the trim areas 44, which trim areas 44 cut the corners between the front wall 18 and the top 22 and bottom 24 walls respectively to present slanted surfaces. In one instance the trim strips 46 are wood and may be secured to the trim areas 44 by adhesive or Velcro™. Alternatively, the trim strips 48 are plastic and present flat surfaces 50 for receiving decorative sheets of material, such as decorative tape. The trim strips 48 present an upturned edge or abutment 52 for abutting the adjacent one of the top and bottom edges 40 of the plate 30. The upturned edge 52 has a top surface with a groove therein for receiving and retaining a decorative bead 54 therein, as for example, a gold or silver bead.

The trim areas 44 have apertures 56 therein and the plastic trim strips 48 have integral posts 58 extending therefrom for insertion into the apertures 56 for securing the trim strips 48 to the trim areas 44. The posts 58 and/or the apertures 56 may include coacting clamping claws or barbs for retaining the posts 58 in the apertures 56. The posts 58 extend at an acute angle relative to the flat surfaces 50 of the plastic trim strips 48 so as to extend substantially perpendicular to the base 14 when attached to the trim areas 44.

The end walls 20 of the housing extend into flanges 60 above the front wall 18 to abut the end edges 40 of the plate 30 and the ends of the trim strips 46 and 48. The flanges 60 of the end walls 40 extend a greater distance above the trim areas 44 than above the above the front wall 18 because of the slanted or falling away disposition of the trim areas 44.

The base 14 includes a battery box 62 extending from the base 14 toward the front wall 18 and is open through the base for placing a battery (not shown) therein from the rear of the assembly. The battery box 62 is adjacent the bottom wall 24 and one end 20 of the housing and is open to the bottom wall 24. The battery box 62 includes two pair of retainer flanges 64 at the inner end of the interior of the battery box 62 for receiving an electrical connector (not shown). Although not shown, the other end of the battery box includes another pair of such retainer flanges. The battery box has a lead opening 66 in the inner end thereof for the passage of electrical leads therethrough between the battery and a circuit board (not shown). The base 14 includes a C-shaped depression 68 opening into the battery box 62 at the inner end of the battery box 62 and extending the lead opening 66 through the base 14.

The base 14 includes a speaker support baffle 70 for receiving an audio speaker assembly (not shown). The speaker support baffle 70 opens toward the top wall 22 and the top wall 22 has slots 72 therein adjacent the speaker support baffle 70 for allowing the audio sound waves to pass therethrough. The speaker support baffle 70 is disposed adjacent one end 40 of the cover 12 to define an L-shaped space in the remainder of the base 14 surrounding the battery box 62 and the speaker support baffle 70. A plurality of support pilings 74 extend upwardly from the base 14 in the L-shaped space for supporting a circuit board.

A plurality of screw tunnels 76 extend upwardly from the base 14 for receiving threaded fasteners 78 and screw posts 80 extend inwardly from the cover 12 and paired in alignment with the screw tunnels 76 for receiving and threadedly engaging the threaded fasteners 78 for securing the cover 12 to the base 14.

The base 14 presents lead retainer ribs 82 which are integral with the base 14 for frictionally retaining electrical leads. The base 14 also includes mounting means for mounting the assembly on the wall 16 in the form of the well known nail or screw head receiving slots 84.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A chime cover assembly (10) comprising:

a box-like housing for supporting the electrical components of a door chime;

said housing having an integral plastic cover (12) presenting a front wall (18) with a periphery and an independent integral plastic base (14) for mounting to a wall (16), said cover (12) having integral end walls (20) and top (22) and bottom (24) walls extending between said end walls (20) to define an open periphery about said walls (20, 22, 24), said walls (20, 22, 24) extending about said periphery of said front wall (18) and filling the area between said walls (20, 22, 24), said base (14) extending over said open periphery about said end walls (20) and said top (20) and bottom walls (22);

said assembly characterized by a decorative plate (30) for being covered (32) and disposed over the exterior of said front wall (18) to cover said front wall (18) and to present a decorative appearance overlying said front wall (18).

2. An assembly as set forth in claim 1 wherein said front wall (18) has holes (34) therein and said plate (30) includes integral projections (36) extending therefrom for insertion into said holes (34) for securing said plate (30) to said front wall (18).

3. An assembly as set forth in claim 2 including claws (38) on the interior of said front wall (18) for gripping said projections (36) at various degrees of insertion thereinto.

4. An assembly as set forth in claim 2 wherein said plate (30) has top and bottom edges (42) and end edges (40).

5. An assembly as set forth in claim 4 wherein said top and bottom edges (42) of said plate (30) are spaced inwardly from said top (22) and bottom (24) walls respectively to define trim areas (44) between said top edge (40) of said plate (30) and said top wall (22) and between said bottom edge (40) of said plate (30) and said bottom wall (24).

6. A chime cover assembly comprising:

a box-like housing for supporting the electrical components of a door chime;

said housing having a cover (12) presenting a front wall (18) and a base (14) for mounting to a wall (16);

a decorative plate (30) for being covered (32) and disposed over the exterior of said front wall (18);

said front wall having holes (34) therein and said plate (30) including integral projections (36) extending therefrom for insertion into said holes (34) for securing said plate (30) to said front wall (18);

claws (38) extending inwardly on the interior of said front wall (18) for gripping said projections (36) at various degrees of insertion thereinto, said base (14) and said front wall (18) being interconnected by end walls (20) and top (22) and bottom (24) walls;

said plate (30) having top and bottom edges (42) and end edges (40), said top and bottom edges (42) of said plate (30) being spaced inwardly from said top (22) and bottom (24) walls respectively to define trim areas (44) between said top edge (40) of said plate (30) and said top wall (22) and between said bottom edge (40) of said plate (30) and said bottom wall (24); and trim strips (46, 48) for attachment to said housing in said trim areas (44).

7. An assembly as set forth in claim 6 wherein said trim strips (46) are wood.

8. An assembly as set forth in claim 7 including an adhesive for attaching said wood trim strips (46) to said trim areas (44) of said housing.

9. A chime cover assembly comprising:

a box-like housing for supporting the electrical components of a door chime;

said housing having a cover (12) presenting a front wall (18) and a base (14) for mounting to a wall (16);

a decorative plate (30) for being covered (32) and disposed over the exterior of said front wall (18);

said front wall having holes (34) therein and said plate (30) including integral projections (36) extending therefrom for insertion into said holes (34) for securing said plate (30) to said front wall (18);

claws (38) extending inwardly on the interior of said front wall (18) for gripping said projections (36) at various degrees of insertion thereinto, said base (14) and said front wall (18) being interconnected by end walls (20) and top (22) and bottom (24) walls;

said plate (30) having top and bottom edges (42) and end edges (40), said top and bottom edges (42) of said plate (30) being spaced inwardly from said top (22) and bottom (24) walls respectively to define trim areas (44) between said top edge (40) of said plate (30) and said top wall (22) and between said bottom edge (40) of said plate (30) and said bottom wall (24); and said trim areas (44) cut the comers between said front wall (18) and said top (22) and bottom (24) walls respectively to present slanted surfaces.

10. An assembly as set forth in claim 9 including trim strips (46, 48) for attachment to said housing in said trim areas (44).

11. An assembly as set forth in claim 10 wherein said trim strips (48) present flat surfaces (50) for receiving decorative sheets of material.

12. An assembly as set forth in claim 10 wherein said trim strips (48) present flat surfaces (50) and an upturned edge (52) for abutting the adjacent one of said top and bottom edges (42) of said plate (30).

13. An assembly as set forth in claim 12 wherein said upturned edge (52) has a top surface with a groove therein for receiving a decorative bead (54) therein.

14. An assembly as set forth in claim 12 wherein said trim areas (44) have apertures (34) therein and said trim strips (48) have integral posts (36) extending therefrom for insertion into said apertures (34) for securing said trim strips (48) to said trim areas (44).

15. An assembly as set forth in claim 14 wherein said posts (36) extend at an acute angle relative to said flat surfaces (50) of said trim strips (48) so as to extend substantially perpendicular to said base (14) when attached to said trim areas (44).

16. An assembly as set forth in claim 9 wherein said end walls (20) of said housing extend above (60) said front wall (18) to abut said end edges (40) of said plate (30) and the ends of said trim strips (46, 48).

17. An assembly as set forth in claim 16 wherein said end walls (20) extend a greater distance above said trim areas (44) than above said above said front wall (18).

18. An assembly as set forth in claim 9 wherein said top wall (22) of said housing includes slots (72) therein.

19. An assembly as set forth in claim 9 wherein said cover (12) includes said front wall (18), said trim areas (44), said end walls (20), said top (22) and bottom (24) walls, said base (14) including a peripheral wall (26) for engaging said cover (12).

20. An assembly as set forth in claim 19 wherein said base (14) includes a battery box (62) extending toward said front wall (18).

21. An assembly as set forth in claim 20 wherein said battery box (62) is open through said base (14).

22. An assembly as set forth in claim 21 wherein said battery box (62) is adjacent said bottom wall (24).

23. An assembly as set forth in claim 22 wherein said battery box (62) is open to said bottom wall (24).

24. An assembly as set forth in claim 20 wherein said base (14) includes a speaker support baffle (70) for receiving an audio speaker.

25. An assembly as set forth in claim 24 wherein said speaker support baffle (70) opens toward said top wall (22), said top wall (22) having slots (72) therein adjacent said speaker support baffle (70).

26. An assembly as set forth in claim 25 wherein said battery box (62) is adjacent said bottom wall (24) and one end of said housing, said speaker support baffle (70) being disposed adjacent said one end to define an L-shaped space in the remainder of said base (14), and support pilings (74) extending upwardly from said base (14) in said L-shaped space for supporting a circuit board.

27. An assembly as set forth in claim 26 including at least one pair of retainer flanges (64) at one end of the interior of said battery box (62) for receiving an electrical connector.

28. An assembly as set forth in claim 27 wherein said battery box (62) has a lead opening (66) in the inner end thereof for the passage of electrical leads therethrough between the battery and the circuit board.

29. An assembly as set forth in claim 28 wherein said base (14) includes a C-shaped depression (68) opening into said said battery box (62) at said inner end of said battery box (62) and extending said lead opening (66) through said base (14).

30. An assembly as set forth in claim 19 including screw posts (80) extending upwardly from said base (14) for receiving threaded fasteners (78) and screw tunnels (76) extending inwardly from said cover (12) and paired in alignment with said screw posts (80) for receiving the threaded fasteners (78) to threadedly engage said screw posts (80) for securing said cover (12) to said base (14).

31. An assembly as set forth in claim 19 including lead retainer ribs (82) integral with said base (14) for frictionally retaining electrical leads.

32. An assembly as set forth in claim 19 wherein said base (14) includes mounting means (84) for mounting said assembly on a wall (16).

33. An assembly as set forth in claim 19 wherein said cover (12) comprises an integral plastic member and said base (14) comprises an integral plastic member.

* * * * *